US008047186B2

(12) United States Patent
Shieh et al.

(10) Patent No.: US 8,047,186 B2
(45) Date of Patent: Nov. 1, 2011

(54) OIL SEPARATOR

(75) Inventors: Tenghua Tom Shieh, Ann Arbor, MI (US); Shohei Nomura, Ann Arbor, MI (US)

(73) Assignee: Toyota Motor Engineering & Manufacturing North America, Inc., Erlanger, KY (US)

( * ) Notice: Subject to any disclaimer, the term of this patent is extended or adjusted under 35 U.S.C. 154(b) by 414 days.

(21) Appl. No.: 12/276,497

(22) Filed: Nov. 24, 2008

(65) Prior Publication Data

US 2010/0126479 A1 May 27, 2010

(51) Int. Cl.
*F02B 25/06* (2006.01)

(52) U.S. Cl. ..... 123/572

(58) Field of Classification Search ..... 123/572–574, 123/41.86

See application file for complete search history.

(56) References Cited

U.S. PATENT DOCUMENTS 4,844,032 A * 7/1989 Groeger et al. ..... 123/196 R
6,412,478 B1 * 7/2002 Ruehlow et al. ..... 123/572
2002/0189213 A1 12/2002 Neuschwander et al.
2003/0000508 A1 * 1/2003 Takahashi et al. ..... 123/572
2003/0150436 A1 8/2003 Stegmaier et al.
2003/0178014 A1 9/2003 Sauter et al.
2004/0159313 A1 * 8/2004 Obayashi et al. ..... 123/572
2005/0092268 A1 * 5/2005 Girard ..... 123/41.86
2005/0161030 A1 7/2005 Roberts et al.
2005/0205072 A1 * 9/2005 Sharman ..... 123/573
2008/0072755 A1 3/2008 Dooley
2008/0223347 A1 * 9/2008 Hommes et al. ..... 123/572

* cited by examiner

*Primary Examiner* — M. McMahon
(74) *Attorney, Agent, or Firm* — Gifford, Krass, Sprinkle, Anderson & Citkowski, P.C.

(57) ABSTRACT

An oil separating device for separating micron and sub-micron particles of oil from crankcase gases is provided. The oil separating device includes a housing having a first chamber in communication with a second chamber, and a narrow wave-shaped passage disposed between the first chamber and the second chamber. The narrow wave-shaped passage is defined by a first inner wall having a first undulating surface opposite and spaced apart from a second inner wall having a second undulating surface mirroring the first undulating surface. The narrow wave-shaped passage is disposed downstream of the first chamber and above the oil drain so as to allow oil particles in crankcase gases passing from the inlet to the outlet to accumulate on the first and second inner walls and assist gravity in forcing the accumulated oil through the narrow wave-shaped passage into the oil drain.

7 Claims, 3 Drawing Sheets

OIL SEPARATOR

FIELD OF THE INVENTION

The invention relates to an oil separating device for separating oil from crankcase gases. More particularly, the invention relates to an oil separating device having a narrow wave-shape passage downstream of a first chamber such that crankcase gases are drawn through the passage in the same direction in which separated oil drains.

BACKGROUND OF THE INVENTION

An internal combustion engine includes a combustion chamber, where a fuel air mixture is burned to cause movement of a set of reciprocating pistons, and a crankcase, which contains the crankshaft driven by the pistons. During operation, it is normal for the engine to experience "blow-by," wherein combusted crankcase gases leak past the piston-cylinder gap from the combustion chamber and into the crankcase. These blow-by or crankcase gases contain moisture, acids and other undesired by-products of the combustion process.

It is normal for crankcase gases to also include a very fine oil mist. The oil mist escapes from the engine to the manifold. The oil mist is then carried from the manifold back into the combustion chamber along with the fuel/air mixture. This results in an increase in oil consumption. Additionally the combustion of the oil mist causes a build up of residuals in the combustion chamber and on pistons which over time decreases engine efficiency. An engine typically includes a Positive Crankcase Ventilation (PCV) system for removing harmful gases from the engine and prevents those gases from being expelled into the atmosphere. Accordingly, it is known to incorporate an oil separating device into a PCV system to remove oil from these crankcase gases. The crankcase gases flow through into localized high velocity areas of the oil separator to promote separation of oil from the gases. The oil is re-introduced back to a sump via a drain device which is located generally at the bottom of the oil separator to allow for gravity to assist the drainage of oil. The sump generally holds excess oil in the system.

Though introducing crankcase gases into a localized high velocity area is sufficient to remove large particles of oil from the crankcase gases, micron and sub-micron particles of oil still remain. Oil separating devices such as Punching and Impactor Plates (PIP), or Cyclone Separators may be used to capture small particles of oil, however these oil separating devices are inefficient at capturing sub-micron oil particles. Furthermore, these devices create a high pressure drop which interferes with the drainage of captured oil. Specifically, the high pressure drop across the device interferes with the force of gravity pulling separated oil particles towards the oil drain. Accordingly, it remains desirable to provide an improved oil separator that is more efficient than conventional oil separator designs in removing micron and sub-micron particles of oil from crankcase gases while at the same time assisting gravity in directing oil towards the oil drain.

SUMMARY OF THE INVENTION AND ADVANTAGES

An oil separating device for separating micron and sub-micron particles of oil from crankcase gases is provided. The oil separating device includes a housing having a first chamber in communication with a second chamber. An inlet interconnects the engine with the first chamber so as to allow crankcase gases to be drawn into the first chamber, and an outlet interconnects the second chamber with the engine intake. An oil drain interconnects the second chamber with the engine so as to allow captured oil to be returned to the engine. The oil separating device further includes a narrow wave-shaped passage disposed between the first chamber and the second chamber. The narrow wave-shaped passage is defined by a first inner wall having a first undulating surface opposite and spaced apart from a second inner wall having a second undulating surface mirroring the first undulating surface. The narrow wave-shaped passage is disposed downstream of the first chamber and above the oil drain so as to allow oil particles in crankcase gases passing from the inlet to the outlet to accumulate on the first and second inner walls and assist gravity in forcing the accumulated oil through the narrow wave-shaped passage into the oil drain.

BRIEF DESCRIPTION OF THE DRAWINGS

Other advantages of the present invention will be readily appreciated, as the same becomes better understood by reference to the following detailed description when considered in connection with the accompanying drawings wherein.

DETAILED DESCRIPTION OF THE INVENTION

Figure 1:
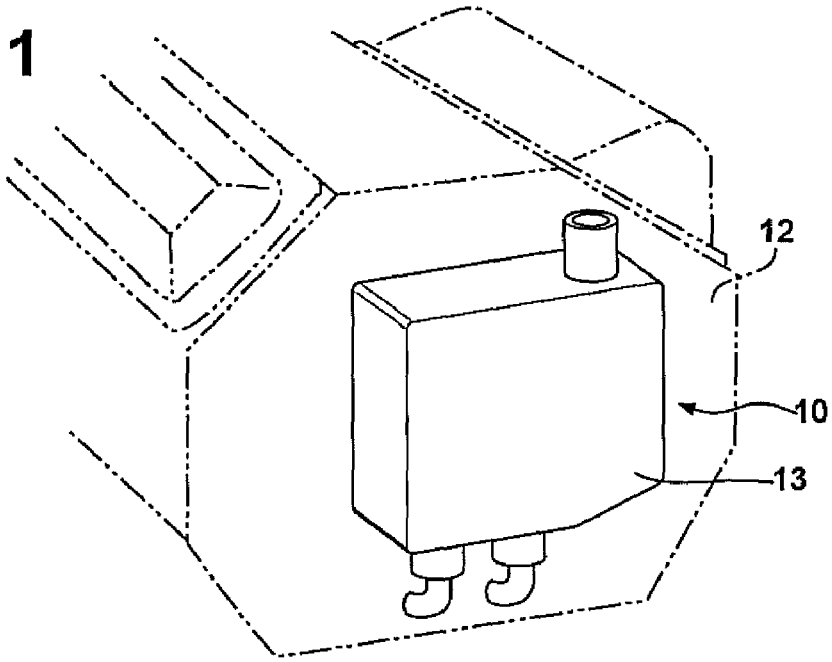
FIG. 1 is a view of the oil separating device mounted to the engine.

Referring to the Figures, wherein like numerals indicate corresponding parts throughout the several views, an oil separating device 10 for separating oil from crankcase gases is generally indicated at 10. With reference now to FIG. 1, the oil separating device 10 is part of the vehicle's PCV system and is mounted to the engine 12 so as to receive crankcase gases from the engine 12 and return filtered crankcase gases to the engine intake. The oil separating device 10 includes a housing 13 having a first chamber 14 in communication with a second chamber 16, an inlet 18, an outlet 20 and an oil drain 22. The inlet 18 interconnects the engine 12 with the first chamber 14 so as to allow crankcase gases to be drawn into the first chamber 14. Crankcase gases may be drawn using a vacuum created in the manifold or by escaping exhaust gases, or may be manually drawn using a motor or the like. The outlet 20 interconnects the second chamber 16 with the engine 12 intake so as to allow crankcase gases to escape. The oil drain 22 interconnects the second chamber 16 with an oil sump so as to collect captured oil for later return to the engine 12.

The oil separating device 10 further includes a narrow wave-shaped passage 24 disposed between the first chamber 14 and the second chamber 16. The narrow wave-shaped passage 24 is defined by a first inner wall 26 having a first undulating surface 28 a opposite and spaced a predetermined distance from a second inner wall 30 having a second undulating surface 32 mirroring the first undulating surface 28. The narrow wave-shaped passage 24 includes at least three undulations. The narrow wave-shaped passage 24 is disposed downstream of the first chamber 14 and above the oil drain 22 so as to allow oil present in crankcase gases to accumulate on the first and second inner walls 26, 30 as the crankcase gases flow from the inlet 18 to the outlet 20. Additionally, the narrow wave-shaped passage 24 is disposed such that gravity assists in forcing the oil accumulated on first and second inner walls 26, 30 through the narrow wave-shaped passage 24 into the oil drain 22.

Figure 2:
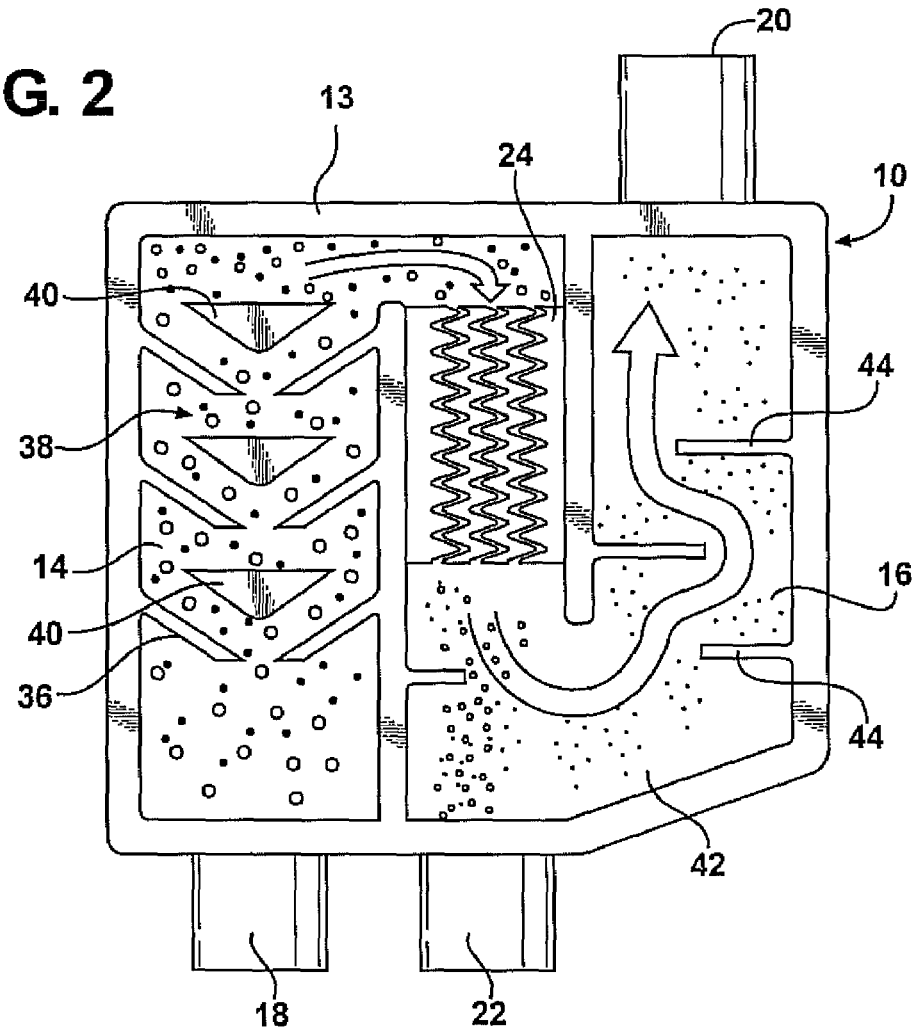
FIG. 2 is a cross-sectional view of the oil separating device of FIG. 1 showing the flow of crankcase gases through the device, and the drainage of oil.
Figure 3:
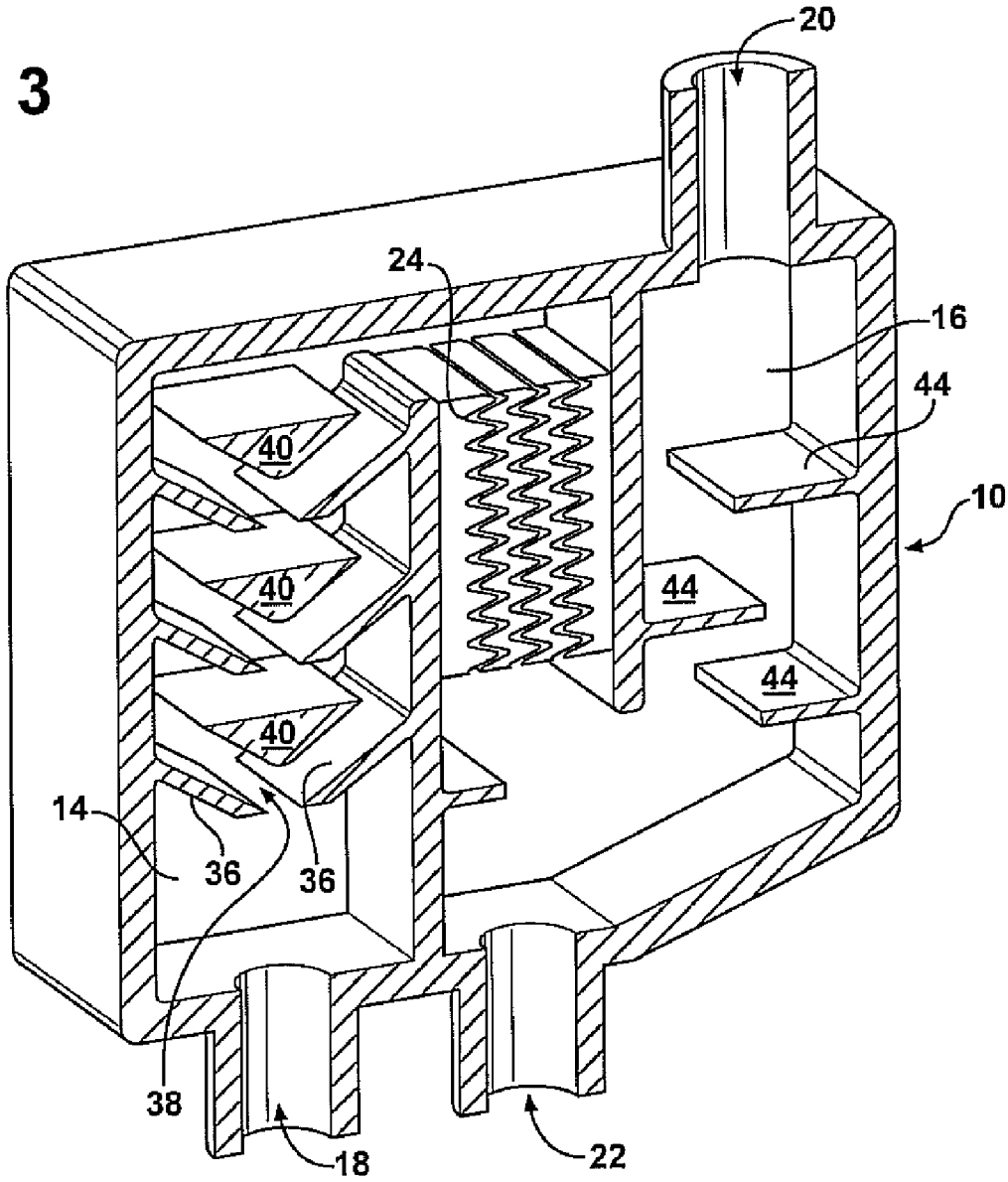
FIG. 3 is a perspective view of FIG. 2.
Figure 4:
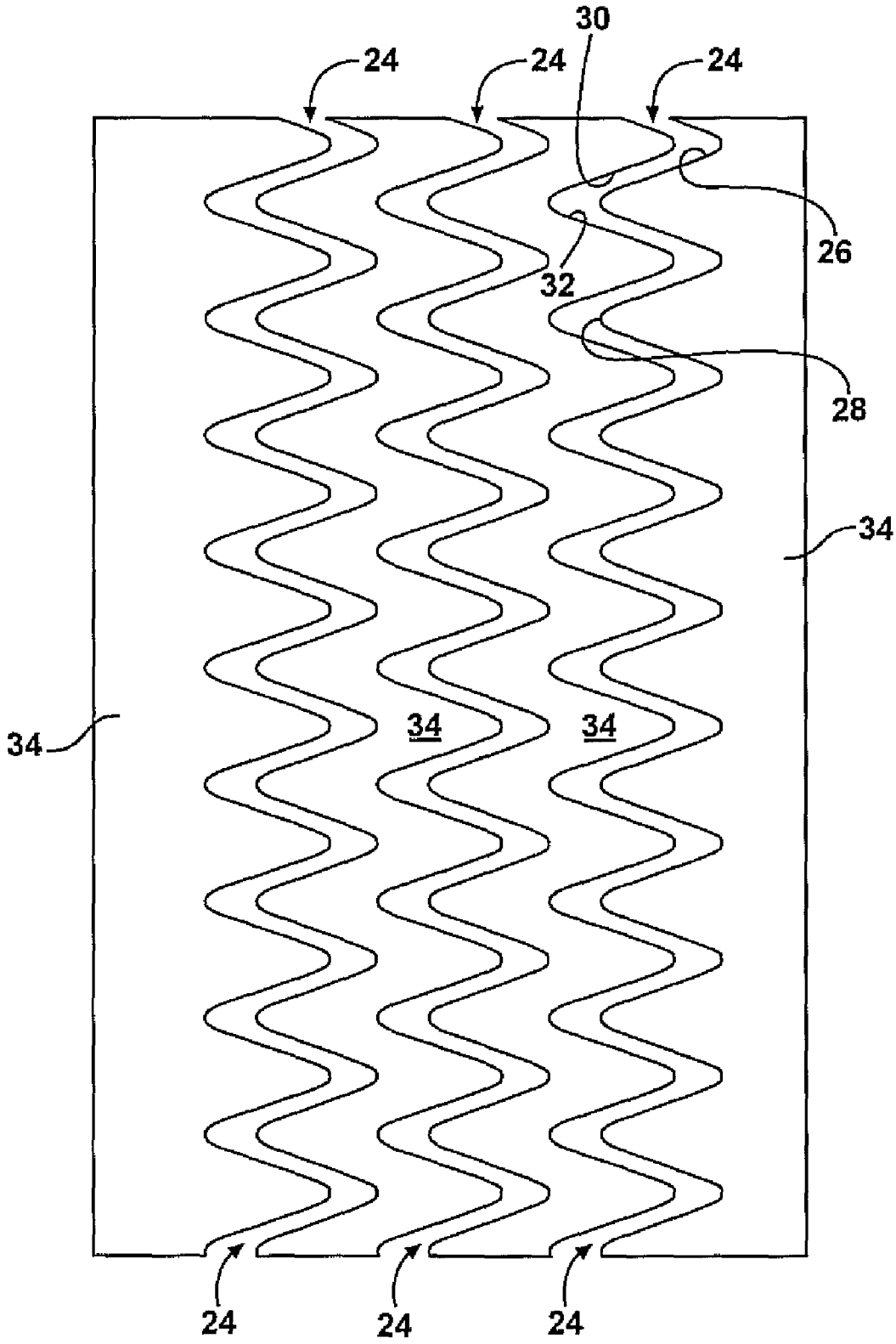
FIG. 4 is an isolated view of the narrow wave-shaped passage.

With reference now to FIGS. 2-4, the oil separating device 10 is shown having three narrow wave-shaped passages 24 disposed in the second chamber 16. However, the number of narrow wave-shaped passage 24 is not critical to the scope and spirit of the invention, and it is anticipated that only one narrow wave-shaped passage 24 is needed.

As stated above, the narrow wave-shaped passages 24 are disposed such that crankcase gases are drawn through the narrow wave-shaped passage 24 in the same direction in which oil drains 22 towards the oil drain 22. The undulating surfaces 28, 32 are disposed on a pair of opposing blocks 34, and are spaced apart from each other such that a desired volume of crankcase gases are drawn therethrough. For example, the undulating surfaces 28, 32 may have an amplitude between 1 mm and 20 mm; a frequency between 0.5 waves/length and 20 waves/length; and a length between 10 mm and 100 mm; and are spaced apart from each other between 0.5 mm and 10 mm. In an engine 12 where the engine 12 pressure varies between 1 atm and 1 atm±20 kPa, the narrow wave-shaped passage 24 is configured such that up to 150 L/min (volume flow rate) of crankcase gases may be drawn through the passage at the maximum pressure at any given instant. The specifications set forth above are meant to be illustrative and are in no way limiting to the scope and spirit of the invention.

With reference again to FIGS. 3 and 4, the first chamber 14 may further include a series of chamber wall 36 partially enclosing the first chamber 14 so as to define a first labyrinth 38. The chamber walls 36 may work in cooperation with a configuration of baffles 40 so as to prevent separate oil particles of a predetermined size from entering into the narrow wave-shaped passage 24. Preferably, the first chamber 14 will separate oil particles larger than 5 microns from the crankcase gases. The baffles 40 are configured so as to define a labyrinth for crankcase gases to navigate. As the crankcase gases are drawn through the first chamber 14, the gases come into contact with the baffles 40 causing particles of oil to separate and drain back into the engine 12 via the inlet 18. The crankcase gases are then further drawn into the narrow wave-shaped passage 24.

When the crankcase gases are passed through the narrow wave-shaped passage 24, the crankcase gases flow in the same direction as the drainage of oil. A liquid film of oil is formed on the undulating surfaces 28, 32 of the narrow wave-shaped passage 24 as crankcase gases come into contact with the undulating surfaces 28, 32. Eventually, the undulating surfaces 28, 32 become coated with oil and as crankcase gases continue to flow between the undulating surfaces 28, 32, micron and sub-micron oil particles are absorbed by the coat of oil. Furthermore, the drainage of oil is not inhibited. Rather, gravity assists the drainage of collected oil by having the flow of crankcase gases in the same direction as the drainage of oil as indicated by the arrows in FIG. 2.

The oil separating device 10 may further include a third chamber 42 in communication with the narrow wave-shaped passage 24. The third chamber 42 defines a large volume of space which calms the flow of crankcase gases to further avoid oil entrainment. Specifically, the chamber is large enough such that captured oil may drain freely into the oil drain 22 without being captured by crankcase gases proceeding to the outlet 20. For example, if the narrow wave-shaped passage 24 is configured such that 150 L/min of crankcase gases may pass through, the third chamber 42 should be configured to be $1\sim1.5\times10^5$ $mm^3$ (volume). The oil separating device 10 may further include at least one partition 44 partially enclosing the second chamber 16 so as to define a second labyrinth to further separate oil particles from crankcase gases which have been entrained.

With reference again to FIG. 2, the operation of the oil separating device 10 will be provided. Crankcase gases, is drawn from the engine 12 into the first chamber 14 as shown by the arrow. The crankcase gases contain both micron and sub-micron particles of oil. As shown, oil particles larger than the micron range are initially separated as the crankcase gases are drawn through first labyrinth 38, defined by the baffles 40 and chamber walls 36 disposed in the first chamber 14. Micron and sub-micron particles of oil in the crankcase gases are then drawn into the narrow wave-shaped passage 24.

The narrow wave-shaped passage 24 is configured to draw crankcase gases along the same direction as gravity. The crankcase gas oils begin to accumulate on the undulating surfaces 28, 32 as those gases are passed through. Eventually, a coat of oil is formed on the undulating surfaces 28, 32. This coat of oil further increases the oil separating abilities of the narrow wave-shaped passage 24 as it attracts and absorbs micron and sub-micron particles of oil. Gravity forces the oil accumulating on the undulating surfaces 28, 32 towards the oil drain 22. Thus, the flow of crankcase gases assists gravity in directing the oil towards the drain, and the oil drips towards the drain as it leaves the narrow wave-shaped passage 24. The dripping oil enters into the third chamber 42 located downstream of the narrow wave-shaped passage 24. The third chamber 42 is large enough so as to calm the flow of crankcase gases and avoid oil entrainment. The filtered crankcase gases then continue through the second chamber 16 and navigate the partitions 44 and exits through the outlet 20.

Obviously, many modifications and variations of the present invention are possible in light of the above teachings and may be practiced otherwise than as specifically described while within the scope of the appended claims.

What is claimed is:

1. An oil separating device for separating oil from crankcase gases, the oil separating device comprising:

a housing having a first chamber in communication with a second chamber;

an inlet interconnecting an engine with the first chamber so as to allow crankcase gases to be drawn into the first chamber;

an outlet interconnecting the second chamber with an engine intake;

an oil drain interconnecting the second chamber with an oil sump;

a narrow wave-shaped passage disposed between the first chamber and the second chamber, the narrow wave-shaped passage having an amplitude and frequency, the narrow wave-shaped passage is defined by a first inner wall having a first undulating surface opposite a second inner wall having a second undulating surface mirroring the first undulating surface, and the first undulating surface is spaced a predetermined distance apart from the second undulating surface, the first and second undulating surfaces each having at least three undulations and wherein the narrow wave-shaped passage is disposed downstream of the first chamber and above the oil drain so as to allow oil found in crankcase gases passing from the inlet to the outlet to accumulate on the first and second inner walls and assist gravity in forcing the accumulated oil through the narrow wave-shaped passage into the oil drain.

2. The oil separating device as set forth in claim 1 wherein the first chamber further includes at least one baffle so as to prevent separate oil particles of a predetermined size from entering into the narrow wave-shaped passage.

3. The oil separating device as set forth in claim 1 further including at least one chamber wall partially enclosing the first chamber so as to define a first labyrinth so as to prevent separate oil particles of a predetermined size from entering into the narrow wave-shaped passage.

4. The oil separating device as set forth in claim 1 further including at least one partition partially enclosing the second chamber so as to define a second labyrinth to further separate oil particles from crankcase gases.

5. The oil separating device as set forth in claim 1 further comprising a third chamber in communication with the narrow wave-shaped passage, wherein the third chamber is down stream of the narrow wave-shaped passage and calms a flow of crankcase gases so as to avoid oil entrainment.

6. An oil separating device for separating oil from crankcase gases, the oil separating device including a housing having a first chamber in communication with a second chamber, an inlet interconnecting an engine with the first chamber so as to allow crankcase gases to be drawn into the first chamber, an outlet interconnecting the second chamber with an engine intake, and an oil drain interconnecting the second chamber with an oil sump, said oil separating device comprising:

a narrow wave-shaped passage disposed between the first chamber and the second chamber, the narrow wave-shaped passage having an amplitude and frequency, the narrow wave-shaped passage is defined by a first inner wall having a first undulating surface opposite a second inner wall having a second undulating surface mirroring the first undulating surface, and the first undulating surface is spaced a predetermined distance apart from the second undulating surface, the first and second undulating surfaces each having at least three undulations and wherein the narrow wave-shaped passage is disposed downstream of the first chamber and above the oil drain so as to allow oil found in crankcase gases passing from the inlet to the outlet to accumulate on the first and second inner walls and assist gravity in forcing the accumulated oil through the narrow wave-shaped passage into the oil drain.

7. The oil separating device as set forth in claim 1, wherein the narrow wave-shaped passage has an amplitude between 1 mm and 20 mm, a frequency between 0.5 waves/length and 20 waves/length, and a length between 10 mm and 100 mm, and the first and second undulating surfaces are spaced apart from each other between 0.5 mm and 10 mm.

* * * * *